United States Patent [19]

Poag

[11] 4,452,441

[45] Jun. 5, 1984

[54] NEWSPAPER STREAM FORMING DEVICE

[75] Inventor: Harold D. Poag, Naperville, Ill.

[73] Assignee: Rockwell International Corporation, Pittsburgh, Pa.

[21] Appl. No.: 303,319

[22] Filed: Sep. 17, 1981

[51] Int. Cl.[3] ..... B65H 3/08; B65H 3/40

[52] U.S. Cl. ..... 271/93; 271/99; 271/12; 271/221

[58] Field of Search ..... 271/11, 12, 13, 14, 271/15, 91, 93, 99, 102, 108, 132, 146, 221, 222; 414/106, 128

[56] References Cited

U.S. PATENT DOCUMENTS

| | | | |
|---|---|---|---|
| 2,756,049 | 7/1956 | Stolz | 271/91 |
| 3,162,988 | 12/1964 | Sherman | 271/106 |
| 3,226,108 | 12/1965 | Bishop | 271/99 |
| 3,476,380 | 11/1969 | Calistrat | 271/132 |
| 3,690,650 | 9/1972 | Maier et al. | 271/221 |
| 4,050,692 | 9/1977 | Marass | 271/91 |
| 4,166,614 | 9/1979 | Hamlin et al. | 271/221 |

*Primary Examiner*—Bruce H. Stoner, Jr.
*Assistant Examiner*—Lisa M. Rosenberg

[57] ABSTRACT

An apparatus for withdrawing single newspapers from the bottom of a stack and presenting them in an overlapped stream to a conveyor for additional processing. The apparatus includes a plurality of gripper members mounted in first and second groups for opposed linear reciprocation on individual rotatably driven stem valves disposed in spaced and parallel relation. The stem valves are operatively connected to a vacuum source and are effective in causing first one group of gripper members and then the other to grip and remove the bottom paper from the stack. To facilitate removal of each paper the apparatus includes a device for effecting a floating action on the individual papers within the stack and vacuum controlled fingers for initiating partial separation of the bottom paper from the stack immediately prior to its withdrawal by the gripper members.

4 Claims, 12 Drawing Figures

NEWSPAPER STREAM FORMING DEVICE

BACKGROUND OF THE INVENTION

The present invention pertains to an apparatus for successively withdrawing single newspapers or the like from the bottom of a stack and more particulary to an improved apparatus which is capable of operating at substantially higher speed than known devices of the prior art and which will present the withdrawn papers in an overlapped stream to a conveyor for further processing.

A number of United States patents show and describe devices for successively removing the lowermost element from a stack of flexible flat pieces such as folded or unfolded sheets of printed matter, and for reference to the teachings of such disclosures attention is hereby drawn to U.S. Pat. Nos. 3,385,593 and 4,127,262.

SUMMARY OF THE INVENTION

The stream forming device according to the invention includes first and second sets of vacuum controlled grippers that are mounted in spaced and parallel relation for opposed linear reciprocation on individual stem valves that are rotatably driven and control the source of vacuum to their respective gripper. The lower newspaper of a stack engages the upper surface of both sets of grippers. When one set of grippers has been activated by the vacuum to grip the lower paper they are caused to slide along their respective stem valve and withdraw the paper and deliver it to a position where it is drawn onto a conveyor. During this movement the other set of grippers is moving in the opposite direction so as to arrive at the starting location of the first mentioned set whereat they are activated by the vacuum source, and immediately prior to said activation said first mentioned set is deactivated. To facilitate removal of each lower newspaper the device includes an agitating mechanism for subjecting the individual papers within the stack to a floating action. Additionally, the device is provided with a pair of spaced and vacuum controlled pivotable fingers which function in cooperation with both sets of grippers by partially separating the lower newspaper from the stack just prior to one or the other of the two sets of grippers being activated by the vacuum source to perform their intended functions.

It is a general object of the invention to provide a device for converting a stack of newspapers or similar articles into a controlled overlapped stream and advance the same by conveyor means to a location for further processing.

A further object is to provide such a device which is capable of operating at substantially greater speed than has been heretofore possible with the known devices of the prior art.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
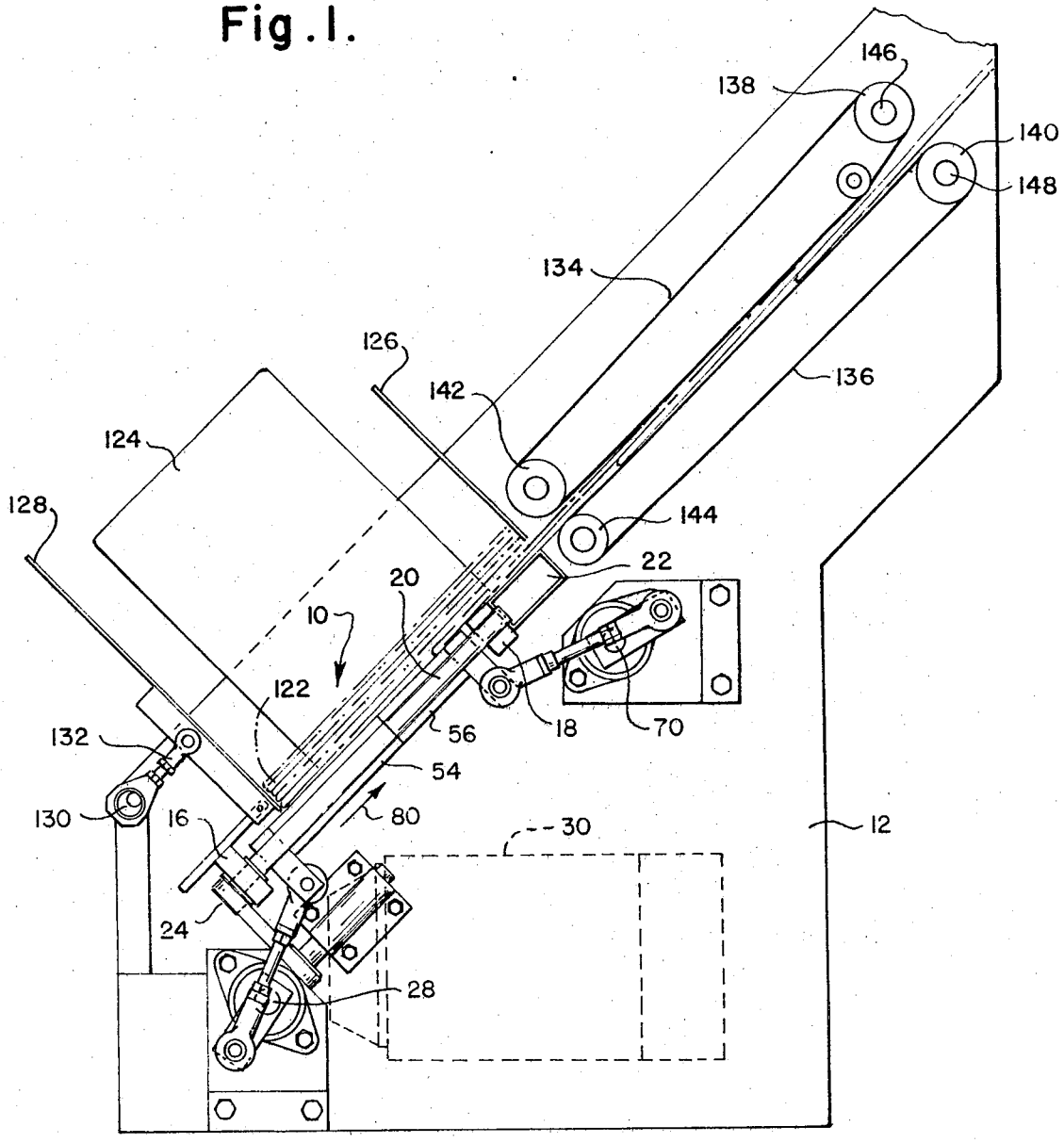
FIG. 1 is a view in side elevation of the stream forming device according to the invention.
Figure 2:
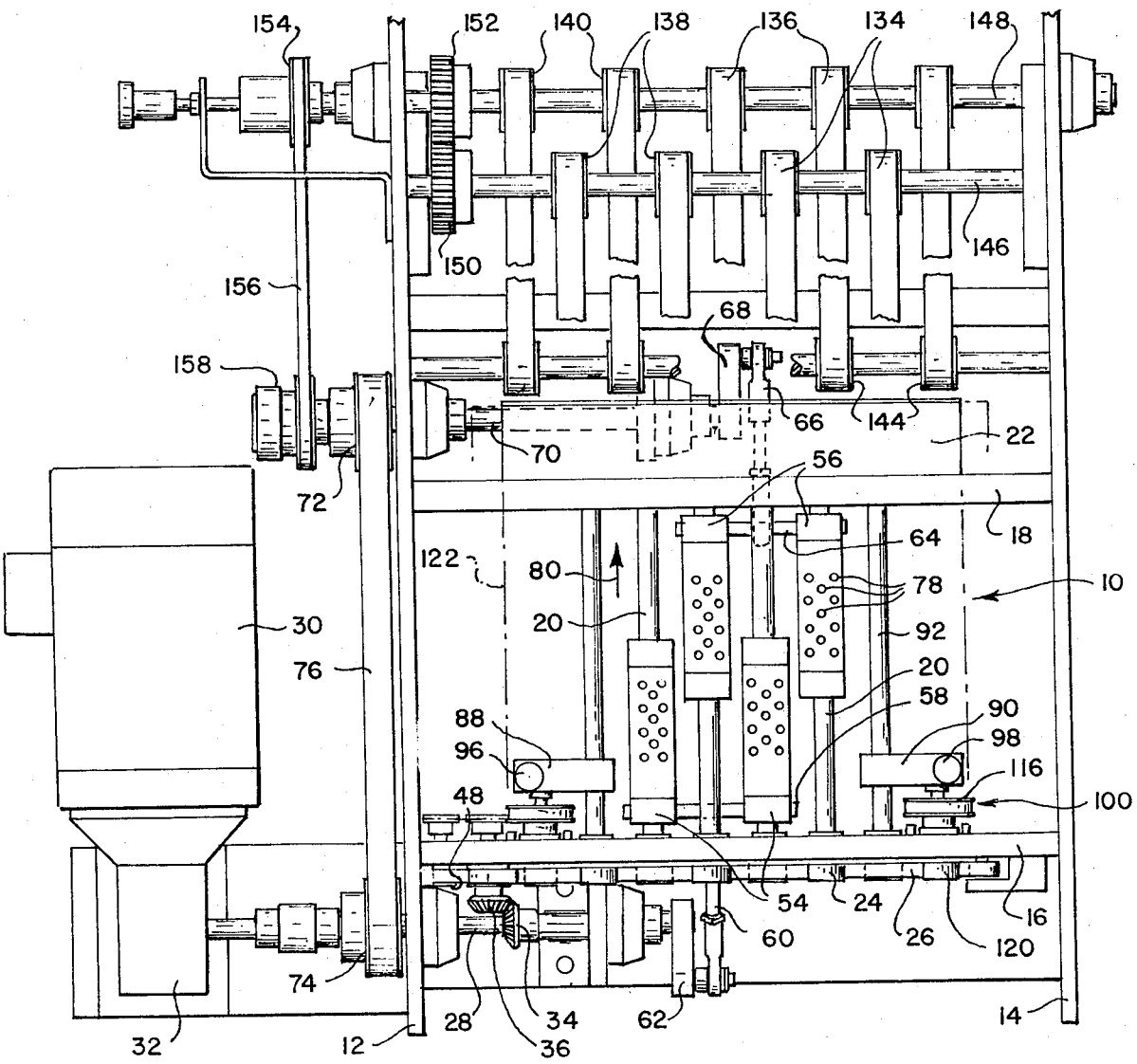
FIG. 2 is a top view of the device shown in FIG. 1.

Referring now to FIGS. 1 and 2 of the drawings, the stream forming device according to the invention is identified generally by numeral 10 and is supported by a pair of spaced frame members 12 and 14. As shown in FIG. 2, these frame members include a pair of spaced connecting elements that traverse the distance therebetween and define support bars 16 and 18. The support bars 16 and 18 are each provided with a plurality of equally spaced openings with those of one bar being in alignment with those of the other, and serve to rotatably support a plurality of stem valves 20 in spaced and parallel relationship. The stem valves 20 are rotatably supported adjacent each of their ends within the openings of bars 16 and 18, and those ends extending from bar 18 are operatively connected to a vacuum chamber 22 which in turn is connected to any suitable source of vacuum not shown. The opposite ends of the stem valves 20 which extend from bar 16 have pulley elements 24 fixed thereon. All of the stem valves are rotatably driven by means of an endless drive belt 26 that is driven by a drive means now to be described.

The device according to the invention includes a main shaft 28 that is rotatably driven by an electric motor 30 through a gear reduction box 32 (FIG. 2).

Figure 10:
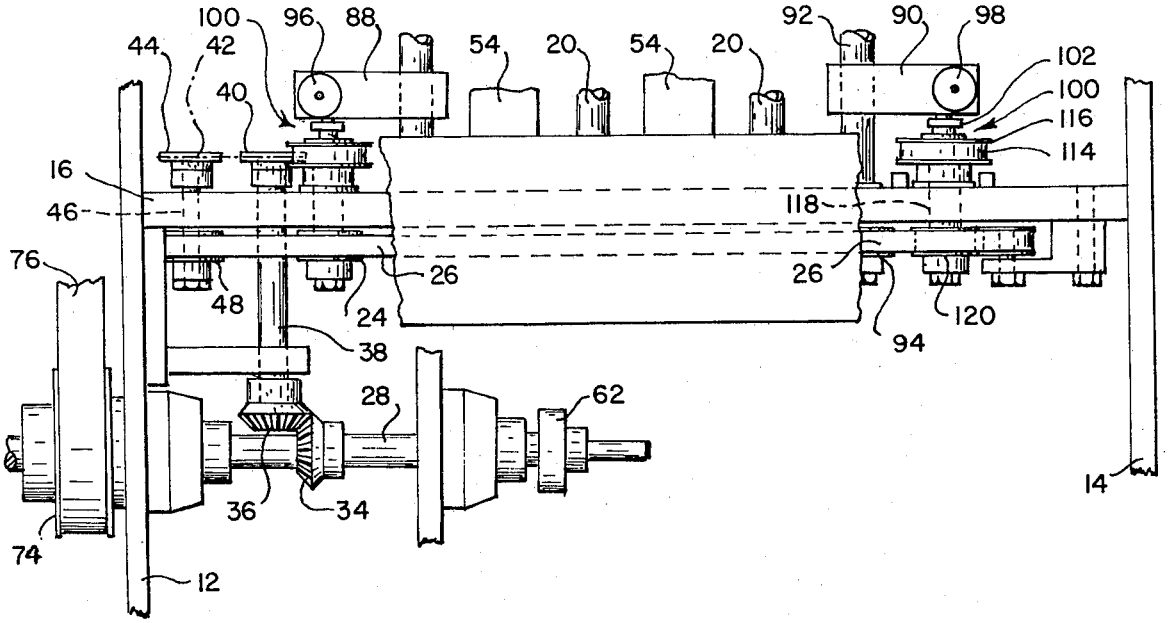
FIG. 10 is a top view of the drive shown in FIG. 9.
Figure 9:
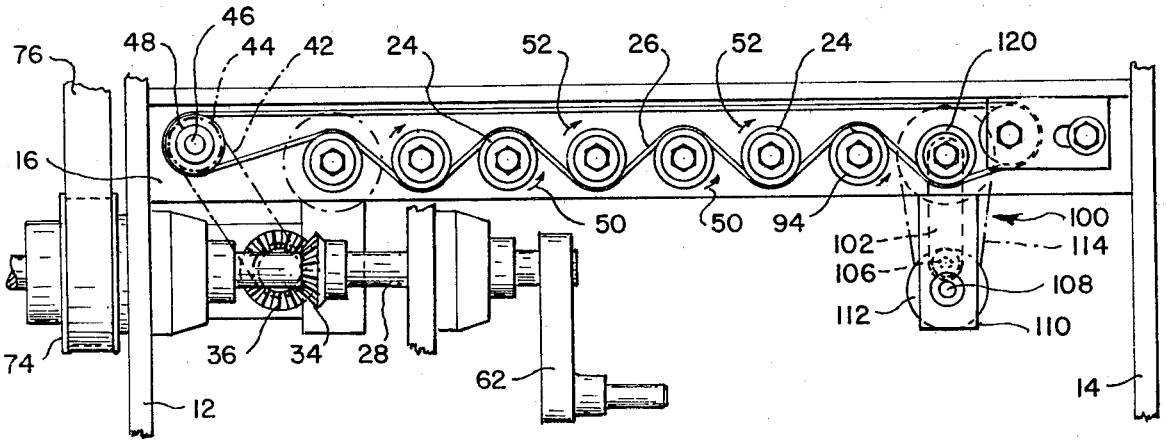
FIG. 9 is a view in end elevation of the drive for reciprocating the gripper members and rotating the individual stem valve.

With reference to FIGS. 9 and 10, a bevel gear 34 is fixedly assembled on the main shaft 28 for rotation therewith and is in meshing relation with a bevel gear 36 assembled on one end of a driven shaft 38. The end of shaft 38 opposite the bevel gear 36 has a sprocket element 40 fixed thereon. This sprocket 40 by means of a drive chain 42 is operatively connected to a sprocket 44 fixed on one end of a shaft 46 that is rotatably supported in the bar 16. The end of shaft 46 opposite sprocket 44 has a pulley element 48 fixed thereon which is in driving engagement with the endless belt 26 and serves by means of the latter to effect rotation of the pulley elements 24 and their respective stem valves 20 in the direction of the indicating arrows 50 and 52 in FIG. 9.

As shown in FIG. 2, each of the rotatably driven stem valves 20 has a gripper member assembled for reciprocating movement thereon. These gripper members are divided into first and second groups that are identified by numerals 54 and 56, respectively. By an independent drive means, yet to be described, for each of the groups of gripper members, said groups are simultaneously reciprocated linearly and in opposed relation.

The first group of gripper members 54 are interconnected by a tube 58 which in turn is operatively connected by means of a connecting rod 60 to a drive crank 62 assembled on the end of the device's main shaft 28.

The second group of gripper members 56 are interconnected by a tube 64 which in turn is operatively connected by means of a connecting rod 66 to a drive crank 68 carried on the end of a driven shaft 70. As shown in FIG. 2, this driven shaft 70 is provided with a pulley member 72 which serves to operatively connect it with a pulley member 74 on the main shaft 28 by means of an endless belt 76.

Referring again to FIG. 2, each of the gripper members of both the first and second groups are provided with a plurality of orifices 78 on their upper surfaces that are timed so that those of one group and then the other are caused to be operatively connected to the vacuum chamber 22 to effect a gripping and withdrawal of the lower newspaper from the stack when caused to move in the direction of the indicating arrow 80 in FIGS. 1 and 2.

Figure 3:
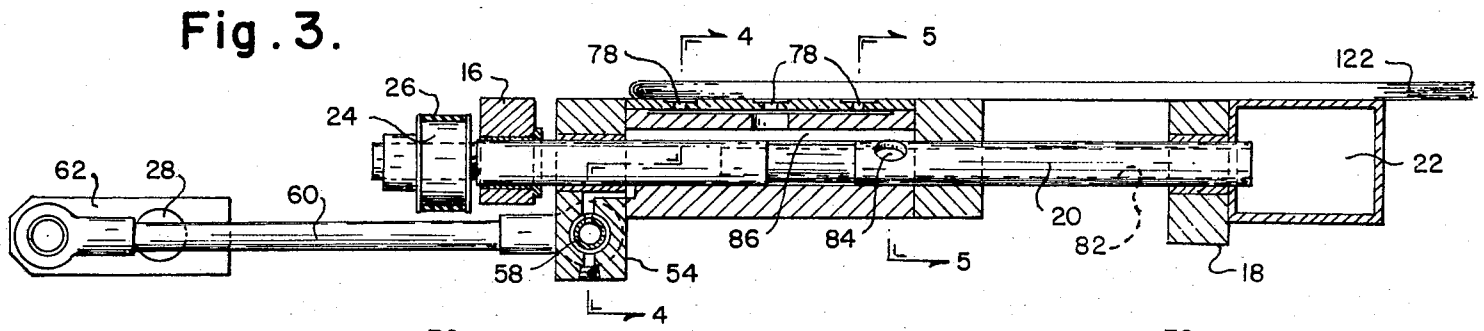
FIG. 3 is a view in side elevation and partially in section of a gripper member showing its respective stem valve and the means for effecting its reciprocating movement thereon.
Figure 5:
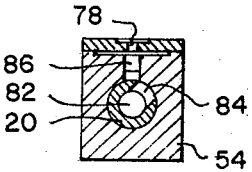
FIG. 5 is a sectional view as seen looking in the direction of the indicating arrows of line 5—5 in FIG. 3.
Figure 4:
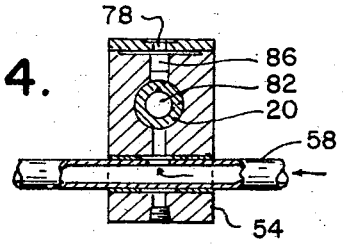
FIG. 4 is a sectional view as seen looking in the direction of the indicating arrows of line 4—4 in FIG. 3.
Figure 6:
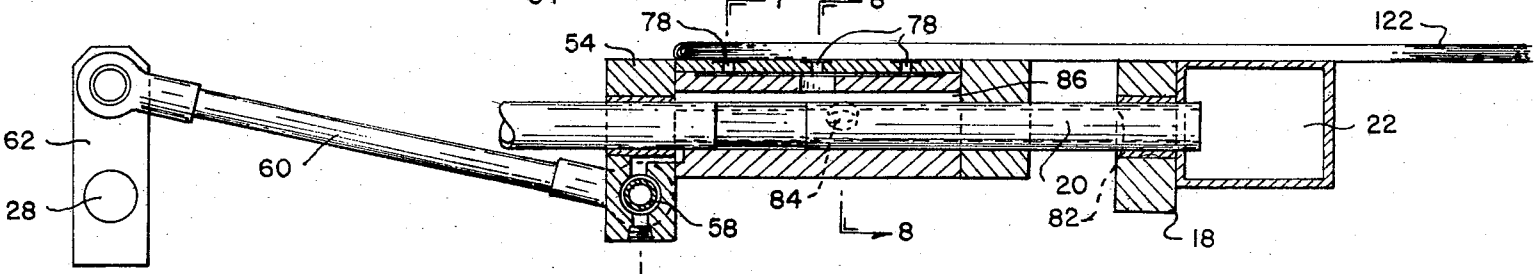
FIG. 6 is a view similar to FIG. 3 showing the crank of the gripper drive means having traveled a distance of 90 degrees to advance said gripper on its respective stem valve.
Figure 8:
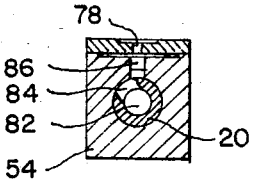
FIG. 8 is a sectional view as seen looking in the direction of line 8—8 in FIG. 6.
Figure 7:
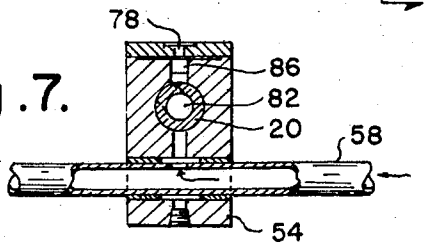
FIG. 7 is an end view partially in section as seen looking in the direction of the indicating arrows of line 7—7 in FIG. 6.

As the means operatively connecting each gripper member through its respective stem valve to the vacuum chamber are identical, only one such member of the first group 54, as shown in FIGS. 3 and 6, will be described in detail.

As heretofore described, the stem valves are rotatably driven by the endless belt 26 and include an axial bore 82. Intermediate the ends of each stem valve an orifice 84 is provided which communicates with its axial bore 82 and during a part of its rotation with an internal chamber 86 provided in its respective gripper member. This internal chamber 86 of the gripper communicates with each of its plurality of orifices 78, and as said gripper is caused to move in the direction of the indicating arrow 80, the stem valve orifice 84 is communicating with the internal chamber 86. When the orifice 84 is communicating with the internal chamber 86, the orifices 78 are interconnected with the vacuum source which is effective in causing the lowermost newspaper to adhere to the gripper and be withdrawn from the stack. As the gripper moves in the opposite direction of the indicating arrow 80, the orifice 84 of the stem valve has been rotated to a position where it does not communicate with the internal chamber 86, so that the orifices 78 are not influenced by the vacuum source as said gripper returns to its starting position. The starting position of each set of grippers is that position at which the first set 54 is located in FIG. 2. In this position and immediately prior to movement of the grippers in the direction of the indicating arrow 80 and their orifices 78 being interconnected with the vacuum source, a means is provided for engaging and drawing down the corners of the lowermost newspaper in the stack so as to partially disengage it from said stack and facilitate its removal from the latter. This means is shown in FIGS. 2, 9 and 10 and defines a pair of spaced pivotally driven and vacuum controlled fingers 88 and 90 that are mounted adjacent the starting positions of the two sets of grippers.

As both of these fingers 88 and 90 are mounted and caused to function simultaneously in a like manner, it is only considered necessary here to describe in detail that finger depicted by numeral 90. Finger 90 is supported for pivotable movement on a stem valve 92 which is spaced from and extends parallel with stem valves 20. Like stem valves 20, stem valve 92 is rotatably supported by support bars 16 and 18 and has one end operatively connected to the vacuum chamber 22. The opposite end of this stem valve 92 has a pulley element 94 fixed thereon which is operatively engaged with the endless drive belt 26 for effecting continuous rotation of said valve. During rotation of the stem valve 92, finger 90 is pivoted upwardly and downwardly in timed sequence with the reciprocating movement of both sets of grippers to and from their starting positions. In other words, each time one or the other of the two sets of grippers arrive at the starting position, the fingers are caused to pivot upwardly and engage the corners of the lowermost newspaper in the stack. The free ends of the fingers 88 and 90 are provided with resilient suction cups 96 and 98, respectively, which are operatively connected to the vacuum source by means of an internal bore within said fingers that communicate with an orifice provided on the stem valves 92.

Figure 11:
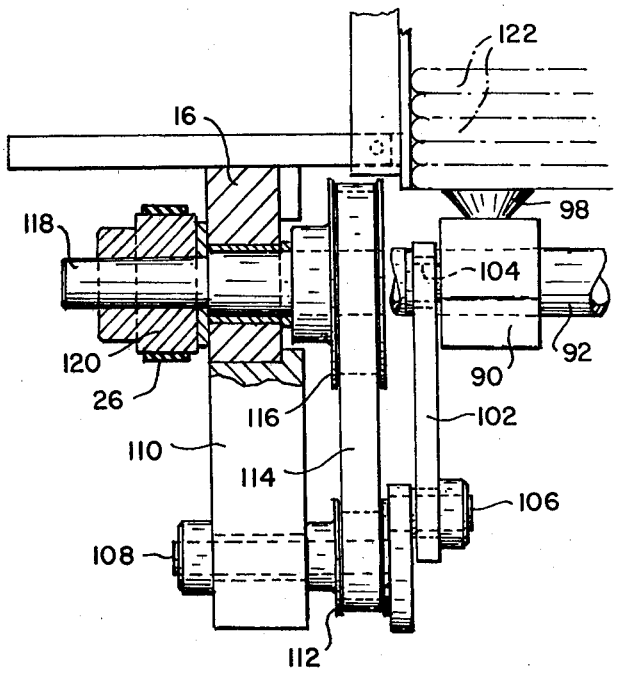
FIG. 11 is a view in side elevation of one of the vacuum controlled fingers for effecting partial separation of the bottom paper from the stack.
Figure 12:
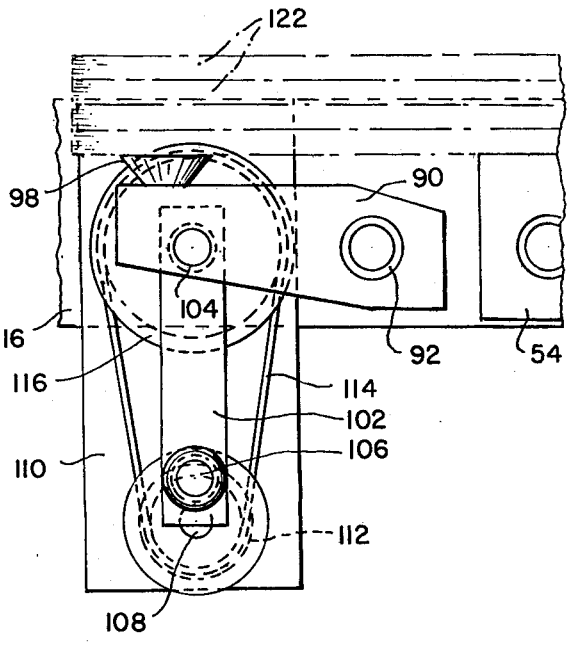
FIG. 12 is an end view of the device shown in FIG. 11.

The means for pivoting the fingers 88 and 90 toward and away from the lower newspaper in the stack define an eccentric or crank type drive generally indicated in FIGS. 2, 9 and 10 by numeral 100. As the drives are identical for both fingers 88 and 90, it is only considered necessary to describe in detail the drive for finger 90. This drive includes a crank arm 102, the upper end of which is operatively connected to the finger 90 by means of a pin 104 (FIG. 11) and the lower end to a crank 106 forming one end of a shaft 108. Shaft 108 is rotatably supported in a bracket 110 attached to and depending from the support bar 16. Intermediate the crank 106 and the bracket 110, shaft 108 has a pulley element 112 fixed thereon (FIG. 9), and by means of an endless belt 114 said shaft 108 is rotatably driven by a driven pulley 116 (FIGS. 11 and 12). This driven pulley 116 is fixed on one end of a shaft 118 that is journaled in the support bar 16, and the opposite end has a pulley element 120 fixed thereon which is disposed in operative engagement with the endless drive belt 26.

Referring now to FIG. 1, the stack of newspapers is identified by numeral 122 and is shown within a hopper-like arrangement in which the first and second sets of gripper members 54 and 56 form the supporting surfaces for said stack. A pair of spaced plate elements 124 form the sides of the hopper-like arrangement which includes an upper end plate 126 having sufficient space beneath its lower edge to permit movement of the lowermost newspaper thereunder.

Spaced from and in opposed relation to the upper end plate 126, the hopper-like arrangement includes a jogging plate 128 which, in a manner to be more fully described, defines an agitating mechanism for continually subjecting the individual newspapers within the stack to a floating action which facilitates withdrawal of the lowermost paper by the gripper members.

This jogging plate is operatively connected to a driving eccentric 130 by means of a connecting rod 132 and said driving eccentric 130 is operatively connected to a suitable source of variable speed drive (not shown) which can be adjusted to accommodate folded newspapers of various thicknesses.

The newspapers, as they are withdrawn from the stack, pass beneath the upper end plate 126 and are advanced for further processing between a plurality of pairs of driven endless belts 134 and 136.

These endless belts 134 and 136 are operatively associated with drive pulleys 138 and 140, respectively, and freely rotatable pulleys 142 and 144, respectively. The drive pulleys 138 and 140 are mounted on driven shafts 146 and 148, respectively, which are interconnected by gear members 150 and 152, respectively. Shaft 148 extends outwardly beyond the frame member 12 (FIG. 2) and has a pulley member 154 fixed thereon, and by means of an endless drive belt 156 it is operatively connected to a pulley member 158 that is assembled on the driven shaft 70.

The newspapers, as they are withdrawn from the stack and pass beneath the upper end plate 126, form an overlapped stream that is advanced by the endless belts 134 and 136 to another conveying apparatus for further processing.

To summarize the operation, the stack of newspapers within the hopper-like arrangement are continuously agitated by the eccentrically driven jogging plate 128 and subject the individual papers within the stack to a floating action which, in combination with the vacuum controlled fingers 88 and 90, facilitates removal of the lowermost newspaper in the stack by the first and second sets of gripper members 54 and 56 which reciprocate in opposed relation and are alternately connected to the vacuum source.

As one set of gripper members is gripping the lower newspaper and moving away from its starting position, the other set is moving toward the starting position and is disconnected from the vacuum source. Immediately prior to movement of each set of gripper members from their starting positions, the vacuum controlled fingers 88 and 90 are caused to pivot upwardly to grip the corners of the lower newspaper and pull it downwardly which partially disengages the lower paper from the stack and facilitates its removal from the latter when the gripper members are connected to the vacuum source and caused to move away from the starting position.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An apparatus for successively withdrawing single newspapers or the like from the bottom of a stack and presenting them in an overlapped stream to a conveyor for further processing, said apparatus comprising:

(a) a plurality of gripping members, each said gripper member including:
  (i) a body defining an interior chamber; and
  (ii) a foraminous wall whereby the interior chamber communicates to the exterior;
(b) valve means mounting said gripper members into separate first and second groups for opposing linear reciprocation between inner and outer end positions;
(c) gripper drive means connected to each of said first and second groups to effect said reciprocation;
(d) a source of vacuum;
(e) means connecting said source of vacuum to the interior of each of said gripper members;
(f) valve drive means connected to said gripper drive means in timed relationship with respect thereto so that vacuum is present in said gripper members only during removal of the bottom newspaper from the stack; and
(g) individual suction means operatively connected to said valve drive means and mounted to contact opposite corners of the lower most newspaper of the stack located adjacent the outer position of said gripper to draw the corners downwardly as said grippers start toward the inner position.

2. The structure according to claim 1 wherein said means for initiating partial separation of the lowermost newspaper in the stack includes:

(a) a pair of spaced pivotably mounted fingers operatively connected to said source of vacuum; and
(b) eccentric drive means connected to each said fingers for engaging and pulling the corners of newspapers downwardly.

3. The structure according to claim 1 wherein said apparatus includes means for agitating of the entire stack for effecting a floating action on the individual newspapers therein to facilitate removal of the lowermost paper by said gripping and releasing means.

4. The structure according to claim 3 wherein said agitating means includes:

(a) a jogging plate disposed in operative engagement with one side of the stack; and
(b) an eccentric drive means connected to said jogging plate.

* * * * *